United States Patent [19]

Terry et al.

[11] Patent Number: 4,841,590

[45] Date of Patent: Jun. 27, 1989

[54] WATER POWERED ROTATING SHOWER BRUSH

[75] Inventors: Robert L. Terry, Evergreen; Daniel V. Sallis, Littleton, both of Colo.

[73] Assignee: Synergetic Industries, Inc., The Woodlands, Tex.

[21] Appl. No.: 37,523

[22] Filed: Apr. 13, 1987

[51] Int. Cl.[4] ..... A46B 13/06

[52] U.S. Cl. ..... 15/28; 15/29; 128/56; 418/61.3

[58] Field of Search ..... 15/23, 24, 28, 29, 22 R, 15/97 R; 418/61 B; 417/310; 128/47, 50, 53, 56

[56] References Cited

U.S. PATENT DOCUMENTS

| | | | |
|---|---|---|---|
| 3,039,123 | 6/1962 | Brucker et al. | 15/29 |
| 3,453,966 | 7/1969 | Eddy | 418/61 B |
| 3,927,434 | 12/1975 | Burgess | 15/24 |
| 4,282,623 | 8/1981 | Gacuzama | 15/29 |

*Primary Examiner*—Edward L. Roberts

*Attorney, Agent, or Firm*—Charles C. Corbin

[57] ABSTRACT

Water-powered rotating brush device for use in a shower, having an elongated handle portion embodying a supply channel and a return channel, a flexible supply and return hose-pair connectable to the lower end of the handle, and a head portion which rotatably mounts a pair of eccentrically located gear rotors with the larger of the rotors having more teeth than the smaller, the rotors arranged so as to be positively displaced into rotary action by the flow therethrough of water under pressure. A massage brush is coupled to the larger gear rotor. A diverter valve rotatably mounted in the handle may be operated to cut off flow to the rotors and to shunt water from the supply channel directly to the return channel. A relief valve includes a spring biased piston that is displaceable by excessive pressure at the rotor head to open a relief port which allows water to by-pass the rotors and flow directly to the return channel.

10 Claims, 3 Drawing Sheets

WATER POWERED ROTATING SHOWER BRUSH

BACKGROUND

1. Field of the Invention.

This invention relates generally to rotary working heads operated by water power, and more particularly to a hand held shower device having a cleansing and massage brush driven in rotation by a positive displacement driving action, with associated flow control means.

2. Description of Prior Art.

Conventional water driven brushes and the like, including those described in U.S. Pat. Nos. 4,228,558, 3,121,857, 2,650,381 and 2,599,911, are characterized by several drawbacks. A common deficiency is the lack of speed control and the inability to provide sufficient torque at relatively low r.p.m.s. The paddle wheels, impellers and water-jet arms of prior devices require high revolutions to generate useful power. A highly revving brush may spin too rapidly for comfortable application to a bather, and further, the application of any appreciable working load to the brush will typically result in a rapid drop off in speed. In addition it is noted that high r.p.m.s. bring noise, vibration, and heightened wear and tear of component parts. Prior water powered cleansing devices characteristically have non-positive displacement driving action which are inefficient, using lots of water relative to the useful work output obtainable therefrom. It is also noted that the operating speeds produced by such conventional devices can vary considerably as does the water main pressure from water district to water district. It is further noted that where such devices are connected to a shower water supply line having a flow restrictor which flow restrictions are governmentally mandated in many cases, the resultant lowered flow rate may be insufficient to propel them is a useful speed and torque range.

In view of these and other prior art shortcomings it is an object of the present invention to provide a water-powered, rotatably driven massage and cleansing shower brush that is simply constructed, and which provides relatively high torque at comfortably low r.p.m.s.

Another object of the present invention is to provide a shower brush whose operational speed is relatively constant; not varying appreciably with load.

A further object of the invention is provision of a rotatable shower brush which harnesses available water power in a very efficient manner.

A still further object is to provide a device whose return line is connectable to a shower spray head, to operate that spray head with a sufficient water flow rate.

One additional object is to provide a water-powered device with a performance that does not vary appreciably with large variations of water mains pressure.

These and other objects will be recognized and achievable by those of ordinary skill in the art by reference to the present invention as described in the following summary, detailed description of drawings, and claims.

SUMMARY OF INVENTION

Accordingly the present invention provides a water powered shower massage brush having an elongated handle portion for enhanced reach, among other things, the handle internally embodying a supply channel that extends longitudinally therethrough and a coextensive return channel. A flexible paired supply and return line is coupled to the corresponding channels at the lower end of the handle. The return line supplies an overhead shower spray head. The upper end of the handle is affixed to a rotor housing portion in which is eccentrically mounted a pair of gear-like rotors. There is a larger diameter rotor that has one tooth more than the smaller rotor, and which larger rotor is adapted for providing a rotating output connection means.

There is an inflow port in one side of the housing that extends as a circumferential segment adjacent to the top edge portions of the rotors, for admitting water in an axial direction into an inter-tooth input zone. A corresponding outflow port is located in the radially other side of the housing and receives water axially from an inter-tooth output zone, and is in flow communication with the return channel of the handle. The invention includes flow diverter means which is hand operable to simultaneously close the flow paths to and from the rotors while opening a direct shunting flow path from the supply channel to the return channel. The invention also features spring biased valve means, responsive to an excessive level of water pressure at the gear rotor supply port, for opening a by-pass flow path directly between the supply channel and the return channel. In one modification of the invention, upon the instance of a pressure overload, the by-pass path is releasably held open. The invention further features a flow restrictor of preselected rating, mounted between the front end of the supply channel and the gear rotor supply port.

BRIEF DESCRIPTION OF THE DRAWINGS

FIG. 2 1's top cross-sectional view taken along the line 2—2 of FIG. 1;

DETAILED DESCRIPTION

Figure 1:
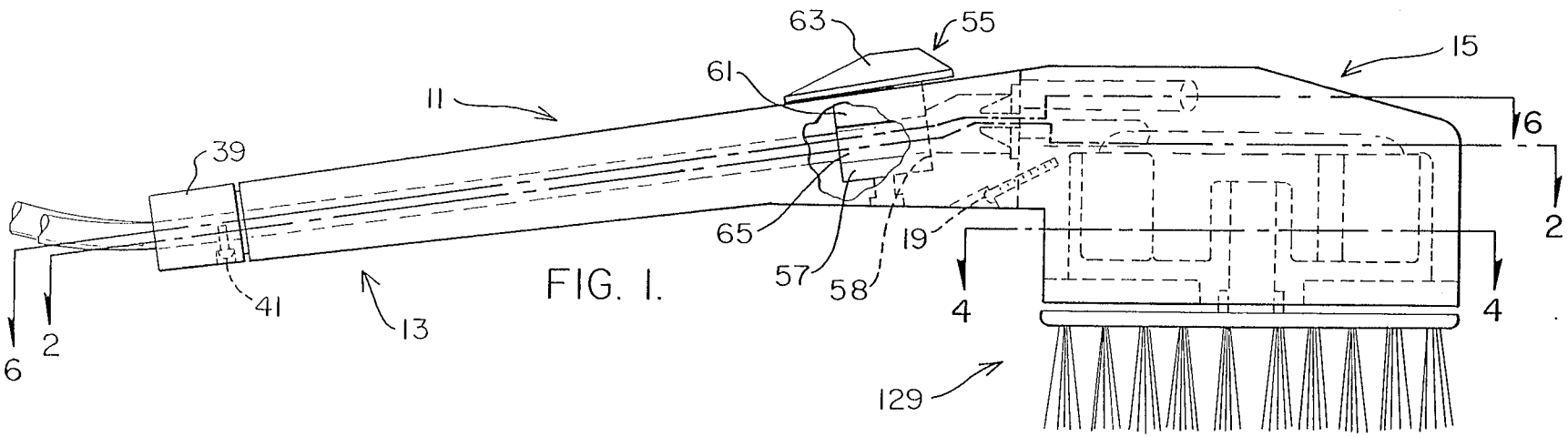
FIG. 1 is a side elevational view of a device according to the invention.
Figure 8:
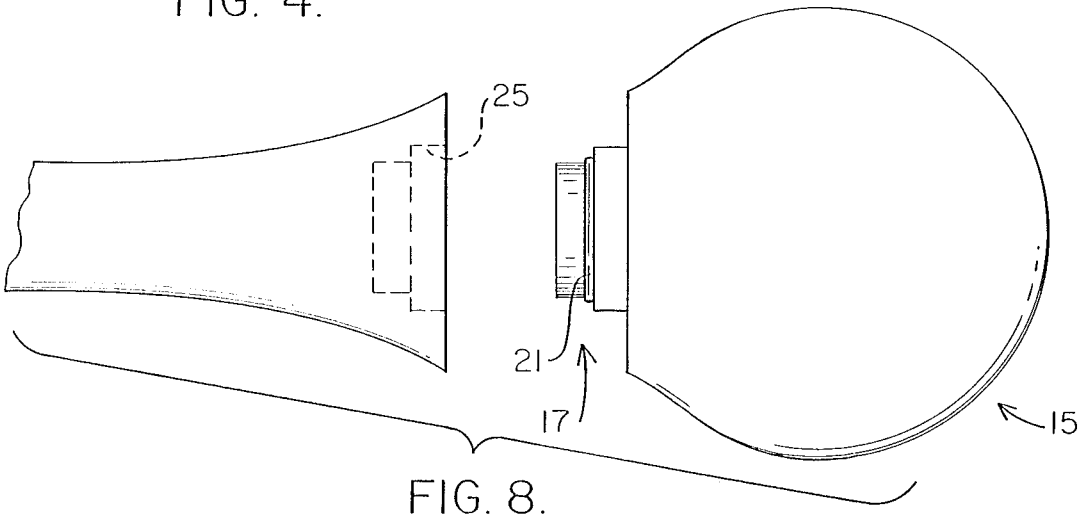
FIG. 8 is a partial top view with parts separated to show assembly.

Referring now to FIG. 1, a water-powered shower massager 11, according to the invention is shown to include injection molded plastic components comprising a handle 13 and rotor housing 15. These two parts are jointed into the single unit shown in FIG. 1, when the rearwardly protruding housing portion 17, best shown in FIG. 8, is mateably received by a corresponding recessed portion in the front end of handle 13. A screw fastener 19, shown in FIG. 1 secures housing 15 to handle 13, and the resulting joint is dimensionally stable. It is noted then an O-ring 21, embracing a shoulder of portion 17, engages an inner shoulder 25 of handle 13 to form a watertight seal. As best shown in FIG.

2, handle 13 is provided with a pair of internal longitudinal channels; i.e. a supply channel 27 and a return channel 29. From the rear end of handle 13 extend end nipples 31 and 33, each having a slightly tapering, corrugated outer surface, and extending respectively from supply channel 27 and return channel 29. A flexible supply hose 35 and flexible return hose 37 snugly embrace nipples 31 and 33 respectively, and are secured thereto in watertight fashion by the support of a cap 35 which is affixed to handle 13 by screw 41.

Figure 9:
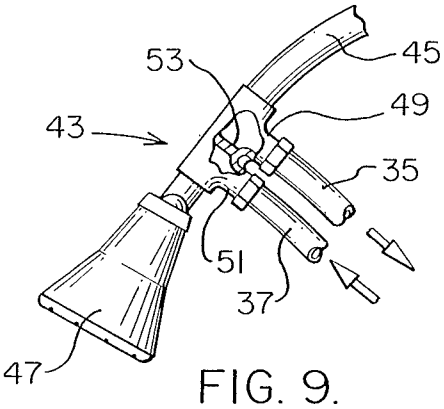
FIG. 9 is a partial view of a shower fixture with the invention.

FIG. 9 shows the rear ends of supply hose 35 and return hose 37 coupled to a shower head fixture 43, which is of a design particularly useful with the invention. Fixture 43 is attached to water supply pipe 45 at its upper end and has a conventional shower spray head 47 at its lower end, and features supply arm 49 and return arm 51 to which are releasably coupled hoses 35 and 37 respectively, by conventional means. Note internal wall 53 that separates the supply water stream from return water flow.

Figure 2:
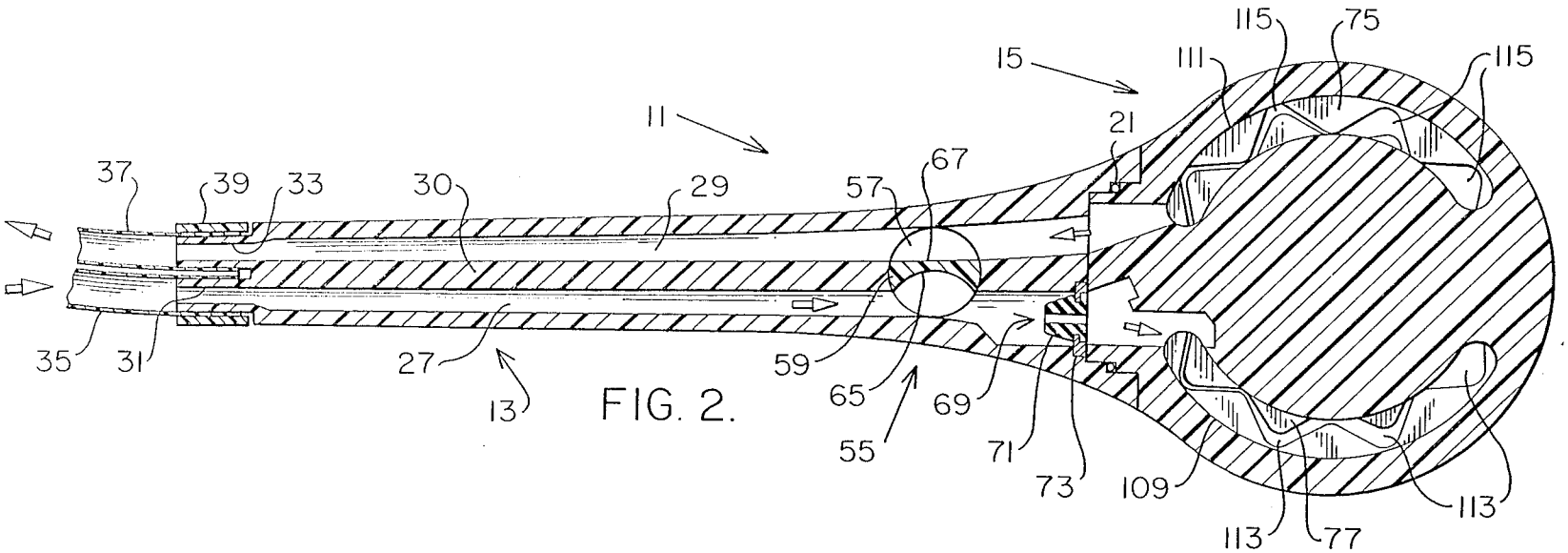

In a forward portion of handle 13 is a flow valve 55 which rotatably mounted about a generally vertical axis as shown in FIG. 1. Valve 55 has a circular bottom portion 57 which is slidably received in circular socket portion 58 of handle 13. There is a valve midportion 59 and a circular top 61 which is sealingly received in a circular upper wall portion of handle 13. A knob 63 is affixed to top 61 by a conventional fastening means. Midportion 59 preferably, as shown in FIG. 2, features a concave face 65 and a flat pace 67, which are rotatable to affect water flow in a manner which will be described hereinafter. A water flow regulator 69 which is mounted in the front end of supply channel 27, has a butyl rubber insert 71 supported on retainer 73.

Figure 3:
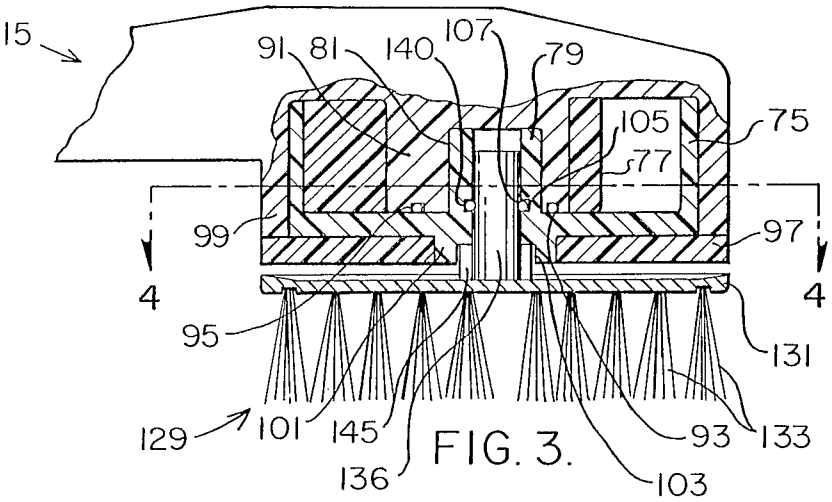
FIG. 3 is a partial side view of the invention with a part of the housing broken away to show the rotor portion in section.
Figure 4:
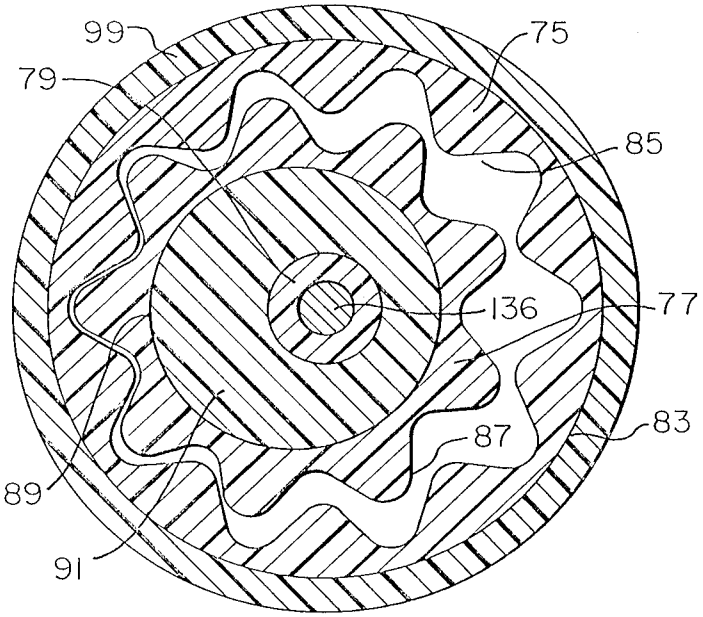
FIG. 4 is an enlarged, cross-sectional view taken along the line 4—4 of FIG. 3.

As FIGS. 3 and 4 show, the rotor housing 15 is so formed as to mount eccentrically to one another a large gear rotor 75 and a small gear rotor 77. Rotor 75 includes an upper central hub portion 79 that is journaled in a bore 81 in the housing 15. The radially outer periphery of rotor 75 is rotatably received in the larger bore 83. There is a greater number of teeth 85 on large rotor 75 than teeth 87 on the small rotor 77. The difference in number is preferably one. The small rotor 77 has a large bore 89 therein by which it rotatably mounts over downshaft 91, which, as evident in FIG. 4, provides a rotational axis that is offset from the parallel rotational axis of the large rotor 75. FIG. 3 shows an O-ring 93 that resides in groove 95 in the bottom of downshaft 91. A bottom lid 97 is affixed and sealed to the bottom edge of housing walls 99, by ultrasonic welding or threaded fasteners (not shown). It is noted in FIG. 3 that the lower central hub 101 of the large rotor 75 is provided with an array of keyway slots 103. In the inner wall of upper hub 79 is circular groove 105 which holds a resilient ring clip 107. The rotors are constructed of durable, wear resistant plastic. Their compositions differ from each other and from the plastic composition of the housing wall 99 and lid 97, to the extent sufficient to minimize the friction factor inherent between surfaces of like material. In the preferred embodiment small rotor 77 composed of a polypropylene plastic and the large rotor 75 is made of a teflon impregnated plastic material.

FIG. 2 shows that the upper portion of the housing 15 is provided with a rotor supply port 109 and rotor return port 111, which ports respectively allow the flow of water axially into first intergear zones 113 and out of second intergear zones 115.

Figure 6:
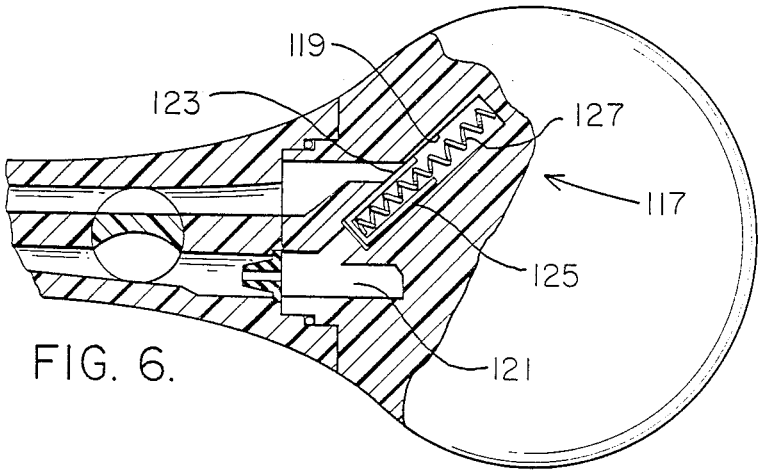
FIG. 6 is a partial top sectional view taken along line 6—6 of FIG. 1.
Figure 7:
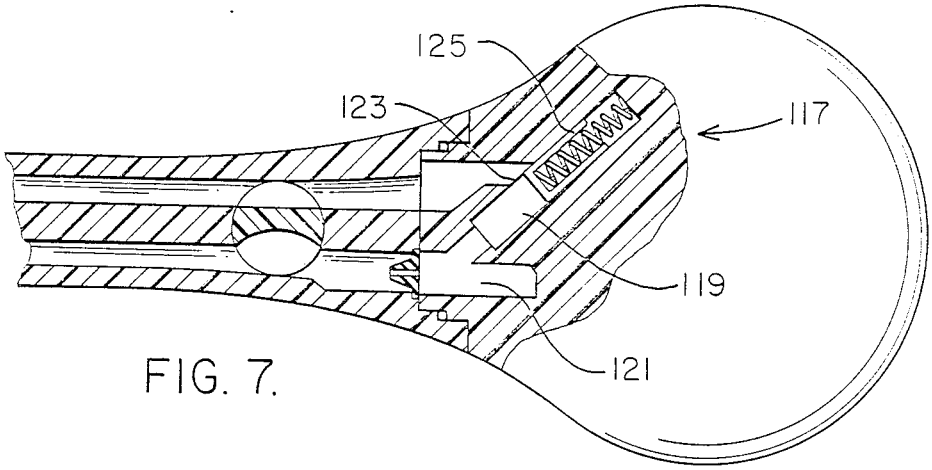
FIG. 7 is also a partial top sectional view taken along line 6—6 of FIG. 1.

FIG. 6 illustrates a pressure relief valve 117 comprising an elongated chamber 119 having one end that opens to chamber 121 adjacent to and communicating with rotor supply port 109. Intermediate along chamber 121 is spill opening 123. A plastic piston 125 is slidably mounted in chamber 119 and is urged by coil spring 127 so as to normally cover the spill opening 123 as shown in FIG. 6.

Brush attachment 129 features a support plate 131 having bristles 133 attached to its lower portion in a conventional manner, and having drive shaft 136 secured to its top surface. The ring clip 107 will snap into engagement with the circular groove 140 in shaft 136 to detachably mount the brush attachment 129 to the rotor housing 15. Arms 145, extending upwardly from plate 131 are received in torque transferring relationship with the slots 103 of the large rotor. It is contemplated under the invention that the lower portion of support plate 131 may be adapted to various other working heads, such as cleansing pads and the like.

Figure 5:
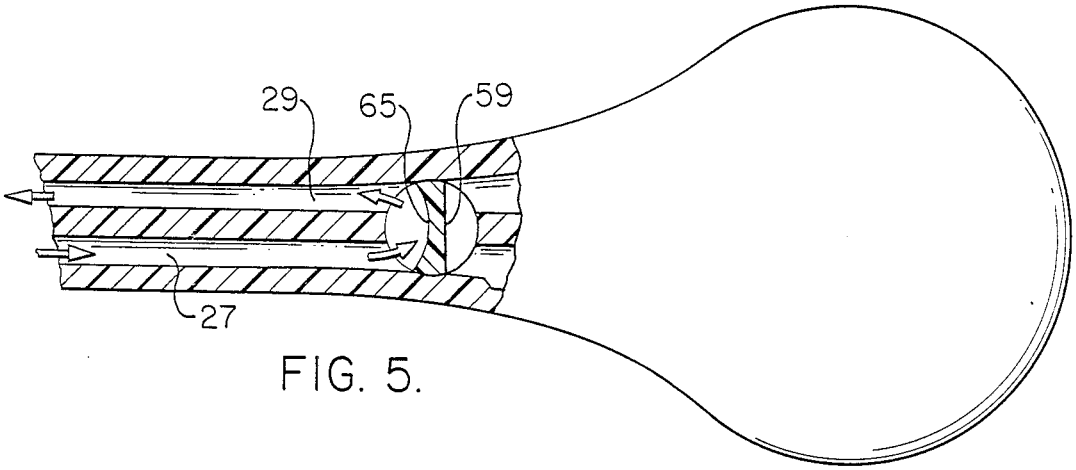
FIG. 5 is a partial top sectional view with parts broken away.

In operation of device 11 according to the invention, the conventional water faucet (not shown) controlling water flow to the shower supply pipe 45 is turned on by the user who may grasp handle 13. Inflowing water will pass via hose 35 into the channel 27, as the arrows in FIG. 2 show. When control valve 55 is in the open (operational) position indicated in FIG. 2, its midportion 55 is generally aligned with common channel wall 30 to allow unobstructed flow in channels 27 and 29. Should the user desire not to operate brush 11, knob 63 is turned 90 degrees to an off position illustrated in FIG. 5. Here the midportion 59 completely obstructs and seals off flow to and from the rotor housing 15, with concave face 65 diverting water flow directly from channel 27 to the return channel 25, and on to the shower spray head to allow the user to enjoy a shower in the usual manner.

When water-powered use of brush 11 is desired flow valve 55 is fully opened and a stream of supply water will pass through the venturi of the rubber insert 71 of flow regulator 69. This is a so-called dynamic flow regulator, of the type available under the trademark FLO-ET. Regulator 69 will, despite large differences in water mains pressure that is present amongst various water supply districts, maintain a constant flow rate therethrough. Water will enter rotor supply port 115 via chamber 121, and into the first integear zones 113. The arrangement and interaction of rotor teeth 85 and 87 is such that the inflowing water will cause positive displacement and counterclockwise rotation of both rotors as viewed in FIG. 2. Water will exit the zone 115 through rotor return port 111, and will pass via channel 25 and hose 37 to be used at the shower spray head 47. The constant water flow provided by the regulator 69 is combined with the positive displacement motor action to give a constant rotational speed at the brush attachment 129. In addition it is noted that the resulting constant high torque is achievable at a flow rate compatible with normal operation of shower spray head 47. The pressure relief valve 117, combines with the aforedescribed performance features to give a measure of safety; i.e. to prevent excessive torque build-up which may occur when the brush attachment 129 is forcefully held against rotation. In the preferred embodiment the brush attachment 129 will be turned at a constant rate of about 200 r.p.m., which rate is comfortable for contact with the skin of a bather. It is also noted that the fairly low pressure drop presented by the invention is also quite compatible with shower use.

While there has been described particular embodiments of the invention, it will be obvious to those skilled in the art that various changes and modifications may be made therein without departing from the invention and, therefore it is aimed to cover all such changes and modifications as fall within the true spirit and scope of the invention.

What is claimed is:

1. Hand held, water-powered device for a rotating working head comprising:

(a) elongated handle portion embodying a pair of generally parallel, longitudinally extending channels therethrough, said pair comprising a supply channel and a return channel; said supply channel and said return channel respectively having an inlet and an outlet end;

(b) a pair of flexible conduits comprising a supply line and a return line, the first end of said supply line having an inlet end which is connectable to a source of water under pressure and its second having an outlet end coupled to the lower said inlet end of said supply channel, and the first end of said return line having an outlet end which is connectable to means for utilizing water flow from said return line and having an inlet end its second end coupled to said outlet the lower end of said return channel;

(c) rotor housing affixed to the upper one end of said handle;

(d) a pair of intermeshing gear rotors comprising an internally toothed outer gear rotor and an externally toothed inner gear rotor disposed within said outer gear rotor, and said rotors rotatably mounted eccentrically with respect to one another with the larger diameter said outer rotor of said pair having more teeth than said inner the small rotor and adapted to be releasably coupled in drive relationship with a rotary working head attachment, said housing providing an elongate, generally circumferential supply port adjacent first ends of said gear rotors for directing water flow axially into a first zone between the teeth of said outer larger rotor and said inner smaller rotor, and a return port also adjacent the first ends of said gear rotors for permitting general axial flow from a second zone between teeth of said rotors, said rotors arranged such that the flow of pressurized water therethrough via said ports will positively displace said rotors and drive them in rotation, said return port in flow communication with the upper said inlet end of said return channel and said supply port in flow communication with the upper said outlet end of said supply channel;

(e) flow diverter, having an external control knob and rotatably mounted within said handle and having an internal portion pivotable to a by-pass position in which water flow to and from said rotors is cut off and in which a direct flow path is opened between said supply channel and said return channel; and (f) rotary working head, detachably coupled to said larger outer rotor.

2. Device as defined in claim 1 including flow control means located upstream of said gear rotor supply port, for restricting the water flow rate through said supply port to a predetermined value which remains generally constant despite appreciable variations in the pressure at which water is supplied to said supply channel.

3. Device as defined in claim 2 wherein said flow control is effective over a paressure range of 15 to 100 p.s.i.

4. Device as defined in claim 2 including pressure overload release means for opening a passage by which water is shunted directly from the region of said supply port and towards said return channel, when the water pressure in said region exceeds a predetermined value.

5. Device as defined in claim 1 including pressure overload release means for opening a passage by which water is shunted directly from the region of said supply port and towards said return channel, when the water pressure in said region exceeds a predetermined value.

6. Device as defined in claim 5 including means for releasably holding said passage open when said pressure is exceeded.

7. Device as defined in claim 5 wherein said release means includes a piston residing in a bore which opens to said supply port region, said piston biased by spring means towards said region and walls of said piston sealing said water shunting passage under normal working pressure and moveable by excessive pressure to expose said shunting passage.

8. Device as defined in claim 1 wherein said working head is a brush.

9. Device as defined in claim 1 wherein said working head is a pad.

10. Device as defined in claim 1 wherein the internal portin of said diverter has a generally concave surface which spans said supply and said return channel and diverts water flow from said supply to said return channel when said diverter is in a by-pass position.

* * * * *